US006713948B2

(12) United States Patent
Meinecke

(10) Patent No.: US 6,713,948 B2
(45) Date of Patent: Mar. 30, 2004

(54) LAMP CAP, ASSEMBLY OF LAMP BURNER AND LAMP CAP, AND METHOD OF FASTENING A LAMP

(75) Inventor: Klaus Eberhard Meinecke, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 298 days.

(21) Appl. No.: 09/913,441

(22) PCT Filed: Dec. 14, 2000

(86) PCT No.: PCT/EP00/12722

§ 371 (c)(1),
(2), (4) Date: Aug. 14, 2001

(87) PCT Pub. No.: WO01/45137

PCT Pub. Date: Jun. 21, 2001

(65) Prior Publication Data

US 2003/0076025 A1 Apr. 24, 2003

(30) Foreign Application Priority Data

Dec. 17, 1999 (DE) ..... 199 61 432
Mar. 24, 2000 (DE) ..... 100 14 840

(51) Int. Cl.[7] ..... H01J 5/48; H01J 5/50

(52) U.S. Cl. ..... 313/318.01; 313/318.05; 313/49; 313/50; 313/624; 313/318.11; 362/226; 362/306; 362/440; 362/449

(58) Field of Search ..... 313/318.01–318.12, 313/49, 50, 624, 625; 362/226, 263, 306, 440, 449, 441

(56) References Cited

U.S. PATENT DOCUMENTS 4,795,939 A * 1/1989 Eckhardt et al. ..... 313/318.01
5,696,424 A * 12/1997 Coushaine ..... 313/318.1
5,742,114 A * 4/1998 Kohl et al. ..... 313/318.01
5,839,818 A * 11/1998 Janson et al. ..... 362/226
6,005,336 A * 12/1999 Helbig et al. ..... 313/318.01
6,033,248 A * 3/2000 Lyons ..... 439/257
6,080,019 A * 6/2000 Coushaine ..... 439/611
6,296,373 B1 * 10/2001 Gal et al. ..... 362/226

FOREIGN PATENT DOCUMENTS

EP 0434155 B1 6/1991 ..... F21M/7/00

* cited by examiner

*Primary Examiner*—Ashok Patel
*Assistant Examiner*—German Colón

(57) ABSTRACT

A lamp cap with a spring cup for retaining a lamp burner, for which it is proposed that the spring cup has at least three spring legs which each have substantially only one degree of freedom. The spring legs are arranged such that the three degrees of freedom enable a displacement possibility of the spring cup in a displacement plane and are linearly independently aligned in this displacement plane.

11 Claims, 1 Drawing Sheet

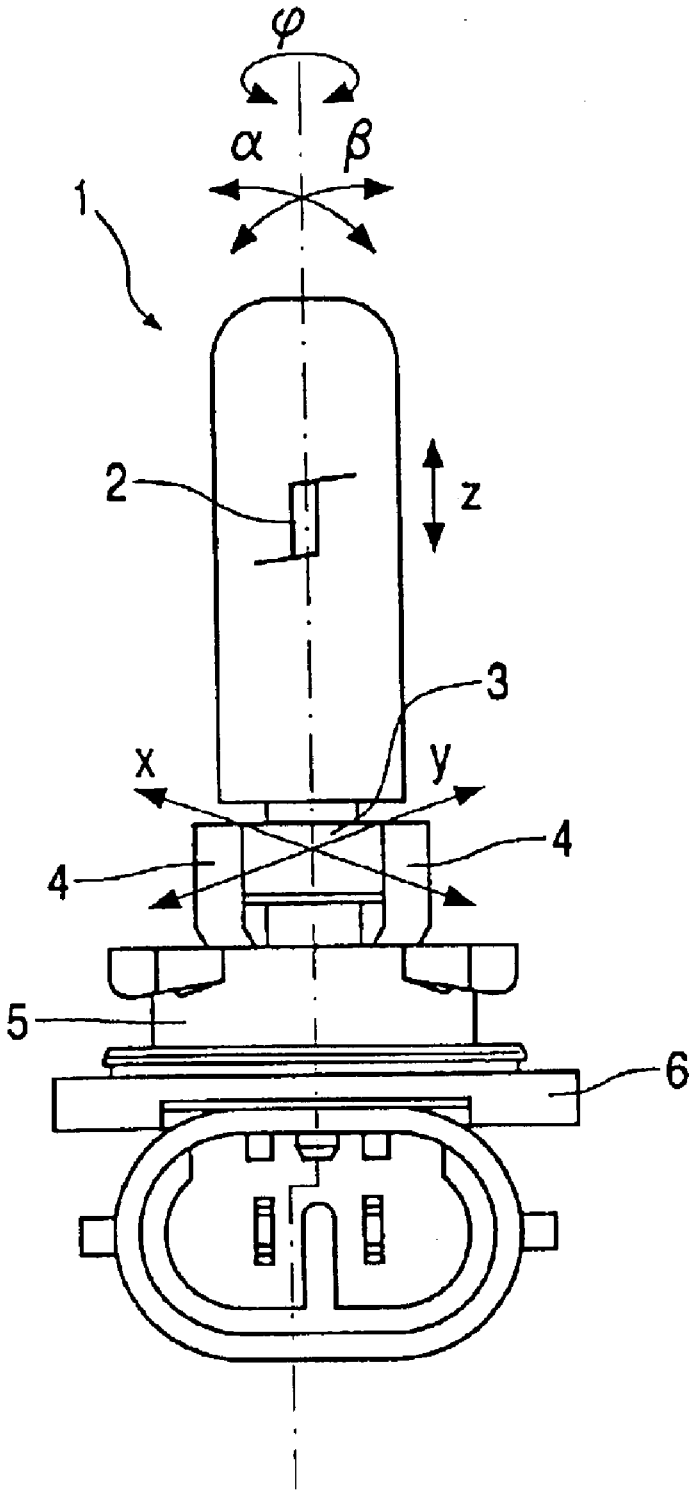
φ
α
β
1
2
z
3
x
y
4
4
5
6

LAMP CAP, ASSEMBLY OF LAMP BURNER AND LAMP CAP, AND METHOD OF FASTENING A LAMP

This application is a 371 application of PCT/EP00/12722, filed Dec. 14, 2000.

The invention relates to a lamp cap with a spring cup for retaining a lamp burner.

In the prior art as described in EP 0 43 155 A1, two additional alignment axes for a better positioning of a lamp coil can be utilized by means of an intermediate adapter or a prefocus ring. This is advantageous because the position of the coil differs from lamp to lamp. Said additional axes may enable an improved adjustment facility for the coil with reference to fixedly defined reference points on a lampholder. This is of importance in particular in connection with modern runway reflectors which impose extremely high requirements on the alignment. The intermediate adapter or prefocus ring used for this, however, is comparatively expensive.

It is an object of the invention to realize a positioning possibility for the coil with respect to defined reference points agreed with a manufacturer of lampholders which is as inexpensive as possible.

This object is achieved in that a spring cup of a lamp cap comprises at least three spring legs which each have substantially only one degree of freedom and which are arranged such that the three degrees of freedom allow a displaceability of the spring cup in a displacement plane, said degrees of freedom being arranged linearly independently of one another in this displacement plane. The intermediate adapter or prefocus ring used until now may be omitted as a result, which reduces the manufacturing cost. The displacement plane mentioned above may be formed by a plane perpendicular to the longitudinal direction of a lamp or alternatively by a plane arranged parallel to a lamp cap. Furthermore, the plane may be formed perpendicularly to the Z-axis.

To achieve a constructionally simple solution, it is suggested that at least one of the spring legs is a blade spring. Furthermore, the simple construction of the spring cup renders it possible to realize an inexpensive automated manufacture of the lamp with low investment and maintenance cost.

It is suggested as a further solution in an assembly of lamp burner and lamp cap that the lamp is fixedly connected to the springs, at least one spring leg in the connected state being subject to a force which is directed in the displacement plane perpendicularly to the direction of the degree of freedom.

The lamp can be kept in its position as a result of this. This exertion of force can be recognized, for example, from the fact that the spring legs when being severed leap away from the lamp axis over different distances. In addition, the lamp axis is shifted when the connection is loosed in an arrangement according to the invention.

The invention furthermore proposes a method of fastening a lamp in a lamp cap whereby the lamp is first aligned with reference to the lamp cap and is subsequently fixedly connected to the spring cup, which method is characterized in that the lamp is aligned in the displacement plane and is kept in the aligned position until it is fixedly connected to the spring cup. A secure and simple position of the lamp in relation to defined reference points can be achieved thereby also with respect to the displacement plane.

To achieve an inexpensive assembling process, the invention provides that the lamp is welded to the spring cup.

The proposed welding technique is advantageous as regards its cost, in particular in an industrial mass manufacturing process. In addition, the use of a welding technique means that a proven connection technique is used which renders possible a simple automation.

It is suggested for a better positioning possibility that the lamp is aligned in accordance with a further degree of freedom. If an exact adjustment is to be achieved of lamps, for example in runway reflectors, it is suggested that the lamp is aligned along at least five axes. Similarly, the lamp may also be aligned along six axes. A further quality improvement as regards the positioning of the coil, of several coils, or of a screening system within a given reference system can thus be achieved.

The arrangement of a lamp burner 1 and a lamp cap as shown in the Figure comprises a coil 2 arranged inside the lamp burner 1, a cylindrical fastening ring 3, a spring cup consisting of three blade springs 4, a fastening bush 5, and a cap 6.

The lamp burner 1 is clamped against the fastening ring 3 by the three blade springs 4 and kept in its position.

The blade springs 4 are arranged inside the fastening bush 5 such that the three degrees of freedom of the blade springs 4 provide a displacement possibility of the spring cup in a displacement plane extending perpendicularly to the Z-axis when the lamp burner 1 is shifted. Furthermore, the respective degrees of freedom of the blade springs 4 are linearly independently arranged in this displacement plane, as is apparent in the Figure, and thus render possible an adjustment and fixation of the coil 2 with respect to a defined reference system, also with respect to the displacement plane.

Abbreviations for dimensional references in a reference system are given below by way of example:

| | |
|---|---|
| Z - axis = | e - dimension = distance of coil 2 to reference |
| X - axis = | g - axis |
| Y - axis = | h - axis |
| $\alpha$ - tilting angle = | g1, g2 - values = maximum skew position |
| $\beta$ - tilting angle = | h1, h2 - values = maximum skew position |
| $\phi$ - angle of rotation (aligned by way of b1, b2 - dimension; 6$^{th}$ degree of freedom) | |

Thus, for example, a reference system for the H8 cap type lies on the inside of a reflector and is defined also for the present assembly as regards the lamp cap and its reference points. The arrangement of the spring cup according to the invention renders it possible to align the coil 2 with respect to the given reference system in a very simple manner.

The spring cup formed from the blade springs 4 can be manufactured very inexpensively, since no more than three blade springs 4 are required for clamping in the lamp burner 1.

The lamp burner 1 is connected to the blade springs 4 such that at least one of the blade springs 4 acts with a force lying in the displacement plane and perpendicular to the direction of the degree of freedom. The lamp burner is kept in its position thereby. This force action can be recognized, for example, from the fact that severing of the blade springs 4 causes the spring legs to leap different distances away from the lamp axis, or that the lamp axis is shifted through loosing of the connection.

Before welding, the lamp burner 1 is first aligned with reference to the cap 6, and in particular also in the displacement plane defined by the X- and Y-axes, and is kept in the aligned position until it has been fixedly welded to the spring cup. The springs adapt the position of the coil 2 along the X-Y-axes during this. In addition, the angular position of the lamp can be influenced within given limits through shifting of the lamp burner 1 in the Z-direction and tilting through the angles $\alpha$ and $\beta$.

The 5-axis alignment method used is advantageous, for example, in the use of H7, H8, H9, H11, or 9004, 9005, 9006, 9007 cap designs because high alignment accuracies can be achieved, for example with the use of a lamp burner 1 in combination with runway reflectors. Moreover, a further correction can be made through a further alignment about the $\phi$-axis, so that in this case a 6-axis alignment is carried out. The term "axis" used in connection with the alignment of the lamp burner 1 represents the degree of freedom along which the lamp burner 1 can be shifted for the purpose of positioning the coil 2.

What is claimed is:

1. A lamp cap with a spring cup for retaining a lamp burner, characterized in that a spring cup of a lamp cap comprises at least three spring legs (4) which each have substantially only one degree of freedom and which are arranged such that the three degrees of freedom allow a displaceability of the spring cup in a displacement plane, said degrees of freedom being linearly independent of one another in this displacement plane.

2. A lamp cap as claimed in claim 1, characterized in that at least one of the spring legs (4) is a blade spring.

3. An arrangement of a lamp burner and a lamp cap as claimed in claim 1, characterized in that the lamp burner (1) is fixedly connected to the springs, at least one spring leg (4) in the connected state being subject to a force which is directed in the displacement plane perpendicularly to the direction of the degree of freedom.

4. An arrangement of a lamp burner and a lamp cap as claimed in claim 1, wherein the spring cup has a holder, characterized in that the lamp burner (1) is fixedly welded to the spring cup in its holder.

5. A lamp cap as claimed in claim 1 wherein said spring cup has only three spring legs.

6. A method of fastening a lamp in a lamp cap which comprises a spring cup as defined in claim 1 wherein the lamp is first aligned with reference to the lamp cap and is subsequently fixedly connected to the spring cup, characterized in that the lamp burner (1) is aligned in the displacement plane and is kept in the aligned position until it has been fixedly connected to the spring cup.

7. A method of fastening a lamp burner as claimed in claim 6 wherein the spring cup has a holder, characterized in that the lamp burner (1) is welded to the spring cup in its holder.

8. A method of fastening a lamp burner as claimed in claim 6, characterized in that the lamp burner (1) is aligned along at least one further degree of freedom.

9. A method of fastening a lamp burner as claimed in claim 8, characterized in that alignment takes place along at least five axes.

10. A method of fastening a lamp burner as claimed in claim 8, characterized in that the lamp burner (1) is aligned along at least six axes.

11. A lamp cap with a spring cup for retaining a lamp burner, characterized in that a spring cup of a lamp cap comprises at least three spring legs (4) which each have substantially only one degree of freedom and which are arranged such that the three degrees of freedom allow a displaceability of the spring cup in a displacement plane, said degrees of freedom being linearly independent of one another in this displacement plane, said lamp burner being fixedly connected to the springs, at least one spring leg (4) in the connected state being subject to a force which is directed in the displacement plane perpendicularly to the direction of the degree of freedom.

* * * * *